United States Patent [19]

Angelini et al.

[11] Patent Number: 4,481,134

[45] Date of Patent: Nov. 6, 1984

[54] METHOD FOR FORMING MICROSPHERES FOR ENCAPSULATION OF NUCLEAR WASTE

[75] Inventors: Peter Angelini, Oak Ridge; Anthony J. Caputo; Richard E. Hutchens, both of Knoxville; Walter J. Lackey, Oak Ridge; David P. Stinton, Knoxville, all of Tenn.

[73] Assignee: The United States of America as represented by the United States Department of Energy, Washington, D.C.

[21] Appl. No.: 343,803

[22] Filed: Jan. 29, 1982

[51] Int. Cl.[3] ..... G21F 9/16

[52] U.S. Cl. ..... 252/628; 252/635; 264/0.5

[58] Field of Search ..... 252/635, 628; 264/0.5; 34/46, 48, 50

[56] References Cited

U.S. PATENT DOCUMENTS 3,434,223 3/1969 Moller ..... 34/46
3,860,691 1/1975 Gens ..... 252/635

FOREIGN PATENT DOCUMENTS 1099652 1/1968 United Kingdom ..... 252/635
1407978 10/1975 United Kingdom .

OTHER PUBLICATIONS

Kanij et al., "Het Sol-Gel Proces", Atoomenergie, 9, (E), (Oct. 1967), pp. 213-224.

Lackey et al., "Alternative High-Level Waste Forms Development", ORNL/TM-7118, (Dec. 1979), pp. 25-32.

*Primary Examiner*—Deborah L. Kyle

*Attorney, Agent, or Firm*—Earl L. Larcher; Stephen D. Hamel; Michael F. Esposito

[57] ABSTRACT

Microspheres for nuclear waste storage are formed by gelling droplets containing the waste in a gelation fluid, transferring the gelled droplets to a furnace without the washing step previously used, and heating the unwashed gelled droplets in the furnace under temperature or humidity conditions that result in a substantially linear rate of removal of volatile components therefrom.

4 Claims, 2 Drawing Figures

METHOD FOR FORMING MICROSPHERES FOR ENCAPSULATION OF NUCLEAR WASTE

BACKGROUND OF THE INVENTION

This invention was made under a contract with the United States Department of Energy and relates to a process for making particles in which nuclear waste is immobilized.

To facilitate its handling and storage, nuclear waste has been incorporated in small spherical particles (referred to hereinafter as microspheres) which are made by various well-known sol-gel processes. In the usual manufacturing procedure such microspheres are gelled while dropping through a liquid and then washed with an aqueous solution before being dried and hardened by calcination, the washing step being required to remove from the microspheres materials such as nitrates and organic compounds that cause them to develop defects (e.g., cracks and blisters that reduce structural stability), or even to disintegrate, during calcination. However, a soluble nuclear waste such as cesium is dissolved from microspheres by the conventional wash step, thus defeating the purpose of encapsulating such waste in the microspheres and producing a radioactive liquid that is difficult to dispose of.

SUMMARY OF THE INVENTION

The object of this invention is to provide a process for forming nuclear waste immobilizing microspheres which are free of defects even though they are not washed before calcination as required heretofore. Because the microspheres are not washed in the process of the invention, they retain even soluble species such as cesium.

This object is achieved by drying and calcining unwashed microspheres of the described type under conditions such that volatile material is removed therefrom at a substantially linear mass loss rate throughout the period of drying and calcination. The temperature or humidity that is required to remove volatile components from microspheres at a uniform rate can be ascertained by providing a furnace with (1) a balance on which a sample of microspheres is held, and (2) means associated with the balance for controlling temperature or humidity in the furnace in a manner which maintains the necessary uniform rate of removal of the volatile components. More particularly, temperature in the furnace is decreased when the balance senses a non-uniform rise in the mass loss rate of volatile material from a sample of microspheres, and furnace temperature is increased when the balance senses a non-uniform drop in mass loss rate. In a furnace operated with humidity control of mass loss rate, humidity is increased when the balance senses a non-uniform rise in mass loss rate and decreased when the balance senses a non-uniform drop in mass loss rate. The temperature-time schedule or humidity-time schedule recorded when a substantially linear mass loss rate has been achieved in the balance-equipped furnace is then programmed into the operation of large scale furnaces used for drying and calcining microspheres.

DETAILED DESCRIPTION OF THE INVENTION

Figure 1:
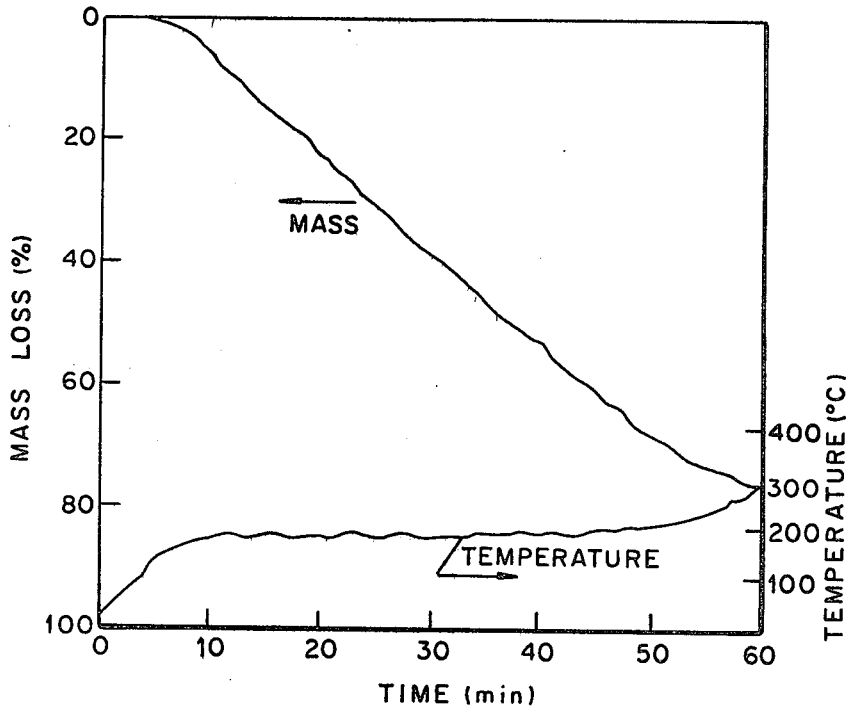
FIG. 1 is a graph depicting mass loss rate of unwashed gel-derived microspheres calcined in accordance with the process of the invention.

Microspheres containing nuclear waste can be made by the internal gelation process wherein droplets of a chilled feed broth containing the waste, matrix components, urea and hexamethylenetetramine (referred to hereinafter as HMTA) are fed to a heated immiscible gelation liquid, the droplets being gelled as they sink in the liquid by ammonia produced from the decomposition of the HMTA.

Waste sludges are partially dissolved in nitric acid and a solution of matrix elements is added to this mixture to provide the feed solution. Most feed solutions of this type contain some suspended solids but these can be tolerated by the gelation system. Urea is dissolved in the feed solution to complex metal ions and prevent premature gelation with HMTA. The adjusted feed is cooled to 0° C. or a slightly lower temperature and then mixed with an HMTA solution precooled to 0° C. The chilled feed broth is fed through a vibrating nozzle into a column of immiscible gelation liquid maintained at a temperature of 55° C., which gelation liquid may consist of various hydrocarbons such as a mixture containing 45 vol.% 2-ethylhexanol and 55 vol.% trichloroethylene. In one solution tested in the process of the invention a small concentration (~0.05 vol.%) of a surfactant (Span-80) was dissolved in the gelation liquid to prevent coalescence of microspheres and attachment of microspheres to the column holding the gelation liquid. Ammonium hydroxide is released by decomposition of HMTA, which is activated by the elevated temperature of the gelation liquid and accelerated by the acidity of the feed solution, causing droplets of the feed broth to gel within 5 to 15 seconds as they fall through the liquid. At this point, the collected microspheres are ready for further processing in accordance with the invention, and the aging and washing steps used in conventional microsphere production processes are not required or performed.

Simulated nuclear waste compositions of two different types were prepared and tested in the process of the invention, namely, a composition representative of the type of waste associated with defense systems and a composition representative of the type of waste associated with the production of power for commercial purposes. The composition of the simulated defense waste used as feed material for product microspheres are shown in the following table, wherein concentrations listed under "Product Microspheres" represent the weight percent of the named materials in microspheres obtained by means of the disclosed process with $ZrO_2$ as a matrix material.

TABLE I

| Component | Defense-Type Nuclear Waste Concentration (Weight %) | | |
|---|---|---|---|
| Dry Metal Oxide Basis | Waste | Matrix | Product Microspheres |
| $Fe_2O_3$ | 49.9 | | 44.9 |
| $Al_2O_3$ | 9.8 | | 8.8 |
| $MnO_2$ | 13.7 | | 12.4 |
| $U_3O_8$ | 4.5 | | 4.1 |
| CaO | 3.7 | | 3.3 |
| NiO | 6.2 | | 5.6 |
| $SiO_2$ | 1.2 | | 1.1 |

TABLE I-continued

| Component | Defense-Type Nuclear Waste Concentration (Weight %) | | |
|---|---|---|---|
| Dry Metal Oxide Basis | Waste | Matrix | Product Microspheres |
| $Na_2O$ | 7.0 | | 6.3 |
| $Na_2SO_4$ | 1.3 | | 1.2 |
| $Ce_2O_3$ | 1.1 | | 0.9 |
| $Nd_2O_3$ | 1.1 | | 0.9 |
| SrO | 0.5 | | 0.5 |
| $ZrO_2$ | | 100 | 10.0 |

The composition of simulated commercial waste tested in the process of the invention is shown in the following table.

TABLE II

| Component | Commercial-Type Nuclear Waste Concentration (Weight %) | | |
|---|---|---|---|
| Dry Metal Oxide Basis | Waste | Matrix | Product Microspheres |
| SrO | 13.1 | | 0.26 |
| $Nd_2O_3$ | 15.1 | | 0.30 |
| $Mo_2O_3$ | 15.4 | | 0.31 |
| $Ru_2O_3$ | 15.0 | | 0.30 |
| $Cs_2O_2$ | 41.3 | | 0.82 |
| $TiO_2$ | | 60.7 | 59.5 |
| $Al_2O_3$ | | 11.1 | 10.8 |
| $ZrO_2$ | | 10.0 | 9.8 |
| BaO | | 4.2 | 4.2 |
| CaO | | 14.0 | 13.7 |

Gelation conditions used in the preparation of the simulated wastes of Tables I and II are presented in the following table.

TABLE III

| | Concentration in Feed Solution | | | | | |
|---|---|---|---|---|---|---|
| Waste Form | Waste Loading (Weight %) | Metal Oxides (g/ml) | Metal (moles/ml) | Free Acid (meq/ml) | Amount used for Gelation (moles/mole metal) UREA | HMTA |
| Defense Type | 90 | 0.22 | 3.0 | 1.5 | 2.3 | 2.0 |
| Commercial Type | 2 | 0.16 | 2.1 | Not Measured | 9.9 | 2.2 |

Nuclear fuel particles were also prepared and tested. Uranium oxide spheres were prepared by the internal gelation process in a similar manner as previously described. The uranium feed solution was at a concentration near 0.4 g $U_3O_8$/ml. The final solution was partially denitrated (acid deficient). The urea and HMTA requirements were somewhat less than the values for nuclear waste materials. Unwashed spheres were tested. The second type of nuclear fuel particle which was tested was $UC_xO_y$. In this case, the spheres were washed and dried and were produced by the external gelation process. The objective in this case was to prevent cracking due to chemical reactions occurring in narrow temperature regions during the calcination and sintering process.

TEST EXAMPLE I

Unwashed gel-derived microspheres containing the simulated defense-type nuclear waste composition tabulated in Table I were successfully dried and calcined by means of the following equipment: (1) a DuPont Instruments 951 Thermogravimetric Analyzer; (2) a DuPont Instruments 990 Thermal Analyzer; and (3) an Analog Series Macsym 2 Computer. The system was operated in the following manner. A sample of gelled microspheres was placed in the thermogravimetric analyzer, and an output signal representing the derivative of the mass of the sample with respect to time was continuously monitored as a function of time by the computer. The computer compared the actual mass loss derivative with a prescribed value and a difference was calculated. A signal proportional to this difference was used by the computer to control the heat power supply of the thermogravimetric analyzer. This feedback control loop resulted in a temperature schedule in the furnace that assured drying and calcination of the microspheres in the desired uniform microsphere mass loss rate shown in FIG. 1. The left ordinate in this graph represents the mass loss rate expressed as percentage of the initial mass of the sample, the right ordinate represents the temperature of the sample during the drying and calcining period, and the abscissa represents time. The sample consisted of 19.43 mg of unwashed gel spheres. It will be noted that the mass loss rate of the sample was substantially linear throughout the drying and calcining period, this linearity being achieved by controlling temperature in the furnace as shown on the graph. The volatile material removed from the microspheres includes water, HMTA, urea, ammonia, and nitrate and chloride compounds. The microspheres obtained by the described process conditions were of good quality.

Figure 2:
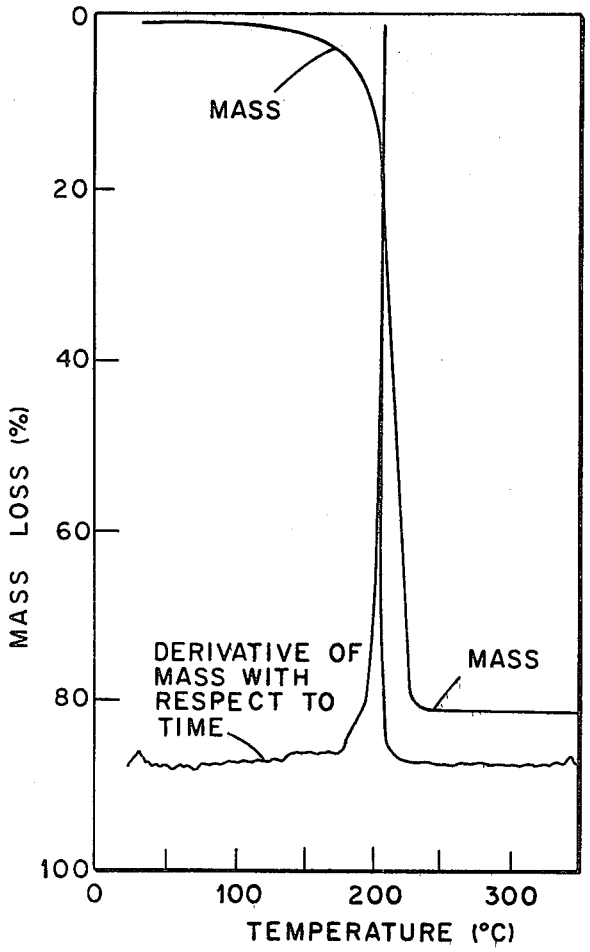
FIG. 2 is a graph depicting mass loss rate of unwashed gel-derived microspheres calcined in a furnace wherein temperature is increased in a conventional manner.

FIG. 2 illustrates data obtained when a 12.71 mg sample of the same type of gel spheres containing simulated defense waste was dried and calcined by the conventional method. In this test, furnace temperature was increased at a rate of 5° C./minute throughout the drying and calcining period. Included in FIG. 2 is a curve illustrating the derivative of mass with respect to time during the conventional furnace heating test. This mass derivative curve shows the extremely rapid decomposition of the test sample which occurred at a temperature of about 200° C. and which completely ruined the microspheres.

TEST EXAMPLE II

Unwashed gel-derived microspheres containing the simulated commercial nuclear waste composition tabulated in Table II were successfully processed using the equipment described in Test Example I. The resulting microspheres had good structural properties and were completely suitable for further processing. However, to process a larger sample of the commercial waste microspheres (30 gm), the temperature versus time schedule followed during the use of the aforesaid equipment and drying and calcining procedure was recorded and an Astro Model No. 725-S furnace was then programmed by means of a computer to follow the same temperature versus time schedule during the drying and calcining of the larger sample in the furnace. The microspheres thus obtained again possessed excellent characteristics which made them well-suited for further processing.

TEST EXAMPLE III

The removal of volatile material from gel-derived microspheres at a substantially linear mass loss rate in accordance with the process of the invention provides the additional advantage of shortening the drying time of washed gel-derived microspheres. In a test using a BMA Envrionmental Chamber with a volume of 8 ft.$^3$, an Arbor balance in the aforesaid chamber for holding a sample and detecting its mass loss, and an Analog Devices Macsym 2 Computer for controlling temperature in the chamber to provide a linear mass loss rate, 400 gm of the previously described simulated commercial nuclear waste microspheres were properly dried and calcined in 2 hours whereas the normal drying and calcining procedure requires 24 hours.

TEST EXAMPLE IV

The equipment described in Test Example III was used to control the drying and calcination of the previously described simulated commercial nuclear waste microspheres, with the modification that humidity in the BMA Environmental Chamber was used to control the rate of removal of volatile components from the microspheres. That is, the mass loss rate of the microspheres was maintained substantially linear over the drying and calcining period by an arrangement which automatically increased humidity in the chamber when the mass loss rate tended to vary from the desired linearity by increasing in a non-uniform manner, and vice versa. The sample of microspheres in this test weighed approxiamtely 300 grams, and the resulting product had good structural characteristics.

TEST EXAMPLE V

Unwashed gel-derived microspheres of uranium oxide were successfully processed in accordance with the principles of the invention using the equipment described in Test Example I. The resulting microspheres had good structural properties. The sample included 27.15 mg of unwashed gel spheres. An argon flow of 50 cc/min was passed over the spheres and the temperature was permitted to go to 600° C. maximum. The spheres lost 57% of their mass in a 170 minute run. A linear mass loss rate of 0.3%/min was maintained during the run. Another experiment using 24.02 mg sample of the same gel-derived microspheres was processed in a conventional manner with an increase in oven temperature of 2° C. per minute up to 650° C. and produced cracked, unusable spheres.

TEST EXAMPLE VI

Washed and predried samples of $UC_xO_y$ (x+y being equal to 2) nuclear fuel were processed in accordance with the principles of the invention. A 51.64 mg sample was run in an argon atmosphere. The spheres had good mechanical and physical properties with very few particles broken. The sample was dried and calcined so that it exhibited nearly linear weight loss during a run time of approximately 2 hours.

We claim:

1. A method for forming microspheres containing nuclear waste, comprising:

contacting droplets containing said nuclear waste with a gelation liquid to gel said droplets;

placing the droplets which have been contacted with said gelation liquid in a furnace without washing said gelation liquid therefrom; and drying and then calcining the unwashed gelled droplets in said furnace while adjusting the humidity or temperature in the furnace so as to remove from said droplets up to about 75% by weight of the water and other volatile material therein at a substantially linear mass loss rate.

2. The method of claim 1 wherein said other volatile material is selected from the group consisting of hexamethylenetetramine, urea, ammonia and nitrate and chloride compounds.

3. The method of claim 1 wherein the temperature in said furnace is responsive to mass loss of said droplets as volatile material is removed therefrom.

4. The method of claim 1 wherein the humidity in said furnace is responsive to mass loss of said droplets as volatile material is removed therefrom.

* * * * *